US012440742B1

(12) United States Patent
Lanzoni

(10) Patent No.: US 12,440,742 B1
(45) Date of Patent: Oct. 14, 2025

(54) TRAINING VOLLEYBALL SYSTEM

(71) Applicant: Shopamova, LLC, Palm Harbor, FL (US)

(72) Inventor: Maurizio Rossi Lanzoni, Trescore Balneario (IT)

(73) Assignee: Shopamova, LLC, Palm Harbor, FL (US)

( * ) Notice: Subject to any disclaimer, the term of this patent is extended or adjusted under 35 U.S.C. 154(b) by 0 days.

(21) Appl. No.: 19/215,308

(22) Filed: May 21, 2025

(51) Int. Cl.

| | |
|---|---|
| ***A63B 69/00*** | (2006.01) |
| ***A63B 41/02*** | (2006.01) |
| ***A63B 41/08*** | (2006.01) |
| ***A63B 43/00*** | (2006.01) |

(52) U.S. Cl.
CPC ..... *A63B 69/0095* (2013.01); *A63B 41/02* (2013.01); *A63B 41/08* (2013.01); *A63B 43/005* (2013.01); *A63B 43/007* (2013.01); *A63B 69/0084* (2013.01); *A63B 69/0086* (2013.01); *A63B 2209/10* (2013.01); *A63B 2243/0095* (2013.01)

(58) Field of Classification Search
CPC ..... A63B 69/0085; A63B 69/0084; A63B 69/0086; A63B 41/02; A63B 41/08; A63B 43/007; A63B 43/005; A63B 2209/10; A63B 2243/0095
See application file for complete search history.

(56) References Cited

U.S. PATENT DOCUMENTS

| | | | | |
|---|---|---|---|---|
| 4,027,880 | A | 6/1977 | Hadtke | |
| 4,235,042 | A | 11/1980 | Hills | |
| 4,240,639 | A | 12/1980 | Bolton et al. | |
| 4,247,117 | A * | 1/1981 | Reichert | A63B 69/0086 473/424 |
| 4,372,561 | A | 2/1983 | Morgan et al. | |
| 5,139,273 | A | 8/1992 | Geroge et al. | |
| 5,358,258 | A * | 10/1994 | Killion | A63B 69/0086 473/576 |
| 5,398,928 | A | 3/1995 | Geroge et al. | |
| 5,451,046 | A | 9/1995 | Batton | |
| 5,575,481 | A | 11/1996 | Lovetere et al. | |
| 5,588,647 | A | 12/1996 | Geroge et al. | |
| 5,669,837 | A | 9/1997 | Hauter | |
| 5,792,014 | A | 8/1998 | Brown | |

(Continued)

*Primary Examiner* — Raleigh W Chiu
(74) *Attorney, Agent, or Firm* — Invention To Patent Services; Alex Hobson

(57) ABSTRACT

A volleyball training system incorporates a training volleyball with ball attachment panels with ball hook-and-loop fastener exposed for detachable attachment of a tether panel by the panel hook-and-loop fastener. The tether panels have an attachment side with the panel hook-and-loop fastener and an exposed side having a tether coupler, such as a tether coupler loop configured to detachably attach with a tether. A single tether may be attached to one of the tether panels and may be attached to a belt, or two tethers, such as suspension tethers may be coupled to two separate tether couples, preferably on opposing sides of the training volleyball to enable the training volleyball to be suspended from supports. The detachable tether couplers enable a person to use the training volleyball for normal play with the tether panels removed. A variety of volleyball hitting types may be practiced with the volleyball training system.

20 Claims, 9 Drawing Sheets

(56) References Cited

U.S. PATENT DOCUMENTS

| | | | | |
|---|---|---|---|---|
| 5,913,739 | A * | 6/1999 | Brenneisen | A63B 43/007 473/417 |
| 5,957,781 | A | 9/1999 | Kelly | |
| 5,984,812 | A | 11/1999 | Sassak | |
| 6,171,205 | B1 | 1/2001 | Hummel | |
| 6,352,484 | B1 | 3/2002 | Killion | |
| 7,445,568 | B1 | 11/2008 | Steffensmeier | |
| 7,998,003 | B2 | 8/2011 | Orr | |
| 2007/0066457 | A1 * | 3/2007 | Abranchess | A63B 69/0086 482/121 |

* cited by examiner

TRAINING VOLLEYBALL SYSTEM

BACKGROUND OF THE INVENTION

Field of the Invention

The invention relates a training volleyball system that incorporates a training volleyball with ball attachment panels having ball hook-and-loop fastener exposed for detachable attachment of a tether panel by the panel hook-and-loop fastener, wherein the tether panel has a tether coupler, such as a tether coupler loop configured to detachably attach with a tether, such as an elastic tether to practice hitting the volleyball.

Background

There are a number of training volleyball system available to restrain a volleyball to tether to practice volleyball hitting skills, such as serving, spiking, setting, passing, digging or even blocking. These systems form an enclosure around the volleyball, such as via a net enclosure, or straps or bands that extend around the volleyball. These belts or enclosures interfere with hitting the volleyball and limit the types of hitting motions that can be performed. They also create an unnatural feel or an uncomfortable feel when hitting the volleyball.

SUMMARY OF THE INVENTION

A volleyball training system incorporates a training volleyball with ball attachment panels with ball hook-and-loop fastener exposed for detachable attachment of a tether panel by the panel hook-and-loop fastener. The tether panel or panels each have an attachment side with the panel hook-and-loop fastener and an exposed side having a tether coupler, such as a tether coupler loop configured to detachably attach with a tether. A single tether may be attached to one of the tether panels, or two tethers, such as suspension tethers may be coupled to two separate tether couples or two tether panels to enable the training volleyball to be suspended from supports. For example, a person may want to practice spiking the training volleyball and may suspend the volleyball at a height that requires them to jump up to hit the ball in a spiking motion. When practicing spiking the training volleyball, two suspension tethers are coupled to the two tether couplers, which may be on tether panels on opposing sides of the training volleyball, to provide a cleared area on the front of the training volleyball for spike hitting practice. When practicing serving the training volleyball a belt may be worn around a person's waist and a belt tether, such as an elastic tether, may extend between the training volleyball, from a tether coupler and the belt. The detachable tether couplers enable a person to use the training volleyball for normal play with the tether panels removed. Also, the tether panels being detachably attachable provide various combinations of training tether configurations that provide a large area of the training volleyball unencumbered by straps, or bands, or enclosures, as required by other training volleyball systems.

A training volleyball has a plurality of panels that are stitched together to form an enclosure around an inflatable bladder. A bladder may be made of latex, butyl rubber, or a similar elastomeric material capable of retaining internal air pressure. A valve is configured on one of the panels to allow inflation of the bladder. An exemplary training volleyball may have six panel assemblies, each with three panels that are coupled together, such as by stitching to form the respective panel assembly. To form the training volleyball, each of the six panel assemblies are coupled to the adjacent or periphery panel assemblies, such as by stitching to form the volleyball.

One or more of the panel assemblies includes a ball attachment panel, having ball hook-and-loop fastener thereon, such as the loop portion of the hook-and-loop fastener, as this is portion of the hook-and-loop fastener is softer than the hook portion that is more coarse. The training volleyball may be used for regular volleyball play or practice with the tether panels detached, as the hook-and-loop fastener is integral to a panel of the panel assembly and does not protrude out from the volleyball. Preferably, a training volleyball has at least two ball attachment panels with two of them on opposing sides of the volleyball to enable suspension tether to extend in opposing directions to suspend the training volleyball without any interference on the panels between the opposing attachment panels. A training volleyball may have three ball attachment panels, four ball attachment panels or even six ball attachment panels, such as one on each of a cartesian axis face of the training volleyball, top, bottom, front, back, left and right-side. Again, it is preferred to have two ball attachment panels on opposing sides of the training volleyball.

An exemplary panel assembly may include a center panel and two perimeter panels and the center panel may have a larger area than the two perimeter panels. The center panel may have the ball attachment panel as it has a larger area to increase the attachment of the tether panel, or increase the force required to detach the tether panel from the ball attachment panel. Also, a center panel of a panel assembly may have convex extensions across the panel assembly that may more effectively secure a tether panel thereto.

An exemplary training volleyball has a plurality of panel assemblies and a plurality of ball attachment panels and preferably at least two of the ball attachment panels are configured on diametrically opposing sides or opposite sides of the training volleyball. In an exemplary embodiment, the training volleyball has only two ball attachment panels and they are configured on diametrically opposing sides of the training volleyball. Also, a training volleyball may have limited surface area occupied by the ball attachment panels to enable regular volleyball play with the tether panels detached. A training volleyball may consist of the two ball attachment panels on diametrically opposing sides of the training volleyball and the other panels may have a volleyball exterior layer, such as a polymeric material, leather that is smooth and free of hook-and-loop fastener material, to enable regular volleyball play without the tether couplers extending from the exterior surface of the training volleyball. Put another way, with the tether panels detached, the training volleyball may have a smooth exterior surface having no protrusion more than 7 mm from the surface of the training volleyball, and preferably no more than 5 mm and even more preferably no more than 3 mm. The hook-and-loop fastener of the ball attachment enables regular volleyball play and may not extend over a very large portion of the exterior surface area of the training volleyball, such as no more than ⅔ of the surface area, or no more than ⅙ of the surface area.

An exemplary training volleyball may be dimensioned and weighted in accordance with regulation volleyball standards when the tether panels are detached. An official volleyball size 5 has a circumference of between 65-67 cm (25.6-26.4 inches), a diameter of between about 20.7 to 21.3 cm (based on the circumference) or 20 to 22 cm when measured, and a weight of between 260 g to 280 g. A training volleyball according to the present invention when fully inflated and with the tether panels removed, had a circumference of 66 cm, a diameter of about 21 cm and a weight of 275 g to 280 g, such that the training volleyball met the official size and weight standards for a size 5 volleyball and therefore would be suitable for volleyball play.

An exemplary tether panel has a perimeter shape that matches that of the ball attachment panel, such as a center panel shape of a panel assembly, which may have convex extension or convex curved panel extensions between the panel ends. A tether panel has an exposed side having a tether coupler, such as a tether coupler loop extending from the exposed side and an attachment side having a panel hook-and-loop fastener for detachable attachment to the ball hook-and-loop fastener of a ball attachment panel. The panel hook-and-loop fastener may extend substantially over the entire attachment side of the tether panel, or over about 75% or more of the attachment side area and preferably about 90% or more of the attachment side area. Likewise, a ball hook-and-loop fastener may extend substantially over the entire exposed area of the ball attachment panel, or over about 75% or more of the area and preferably about 90% or more of the ball attachment panel area. Also, the area of the hook-and-loop fastener of the tether panel and the area of the hook-and-loop fastener of the ball attachment panel may be substantially the same, or within about 20% of each other and preferably within 10% or even 5% of each other.

An exemplary volleyball training system may include one or more suspension tethers that have a suspension tether ball-end connector on the suspension tether ball-end, which may be loops for retaining the suspension tether to the tether coupler by extending the suspension tether through the tether coupler, such as a tether loop, and then passing the suspension tether through the loop of the suspension tether ball-end connector. A suspension tether may also have a suspension tether retainer end connector on the suspension tether retainer end, which again may be a loop for retaining the suspension tether to a support by extending the suspension tether around the support and passing the suspension tether through the loop of the suspension tether retainer end connector. A suspension tether may be elastic whereby the suspension tether can be stretched and then return to an original length upon removal of a stretch force. This enable a person to hit the training volleyball away from them and have the training volleyball return for a subsequent hitting practice. A suspension tether may be able to extend at least 100% and return to an original length, for example. A suspension tether may be effective long to allow suspension from a support and allow freedom of movement of a person to jump and hit the training volleyball. A suspension tether may have a resting length, a length with no force applied, such as when laying on a flat horizontal surface, of about 1.5 m or more, about 2 m or more, about 2.5 m or more, about 3 m or more and any range between and including the length values provided. A suspension tether may have a elongation force when elongated 150% from a resting length of about 70 N or more, about 80 N or more, about 90 N or more, or even 100 N or more and any range between and including the force values provided.

An exemplary volleyball training system may include a belt configured to extend around a person's waist and a belt tether configured to extend between a tether coupler on the training volleyball and the belt. A belt may have an outside surface with a panel of belt-outside hook-and-loop fastener on a one end of the belt and an inside surface with a belt-inside hook-and-loop fastener on the opposing end of the belt. The belt can be looped around a person's waist and the belt hook-and-loop fasteners can be detachably attached to secure the belt around a person to secure a belt tether to the person. A belt may also have a belt connector, such as belt connector ring to enable quick connection of a belt tether thereto. A belt may be effective wide and may be padded for comfort and to displace the forces caused by the training volleyball being hit away from the person before being retracted by an elastic belt tether.

The belt tether may be shorter in length than a suspension tether and may have a resting length from a ball-end to a belt-end of about 0.5 m or more, about 0.75 m or more, about 1 m or more, about 1.5 m or more, about 2.0 m or more and any range between and including the length values provided. A belt tether has a ball-end that may have a belt tether ball-end connector, such as a loop, and a belt tether belt-end that may also have a belt tether belt connector, such as a loop, or a clip or carabiner for quick connection to a loop or attachment on the belt. A belt tether may have a belt swivel to enable the belt tether belt-connector to swivel with respect to the belt tether extension to the training volleyball, to prevent the belt tether from twisting which may cause the connector to break or detach. A belt tether may have an elongation force when elongated 150% from a resting length, of about 10 N or more, about 12.5 N or more, about 15 N or more, or even 20 N or more and an elongation force at 200% elongation of about 15 N or more, about 20 N or more, about 25 N or more, about 30 N or more and any range between and including the force values provided, respectively.

A person may practice serving the training volleyball by using the volleyball training system with the belt donned around their waist and the belt tether coupled to the belt connector on the belt tether belt-end and coupled to a tether coupler on the training volleyball on the belt tether ball-end. A person may practice other volleyball hitting motions, such as spiking, setting and/or passing with the training volleyball coupled to the belt by the belt tether as well. A belt tether may be coupled to the belt or to another support, such as an overhead support or a ground support to retain the training volleyball while practicing hitting the volleyball. A belt tether may be coupled to a pole or a basketball hoop, above a person's head, to practice serving or other hitting motions.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
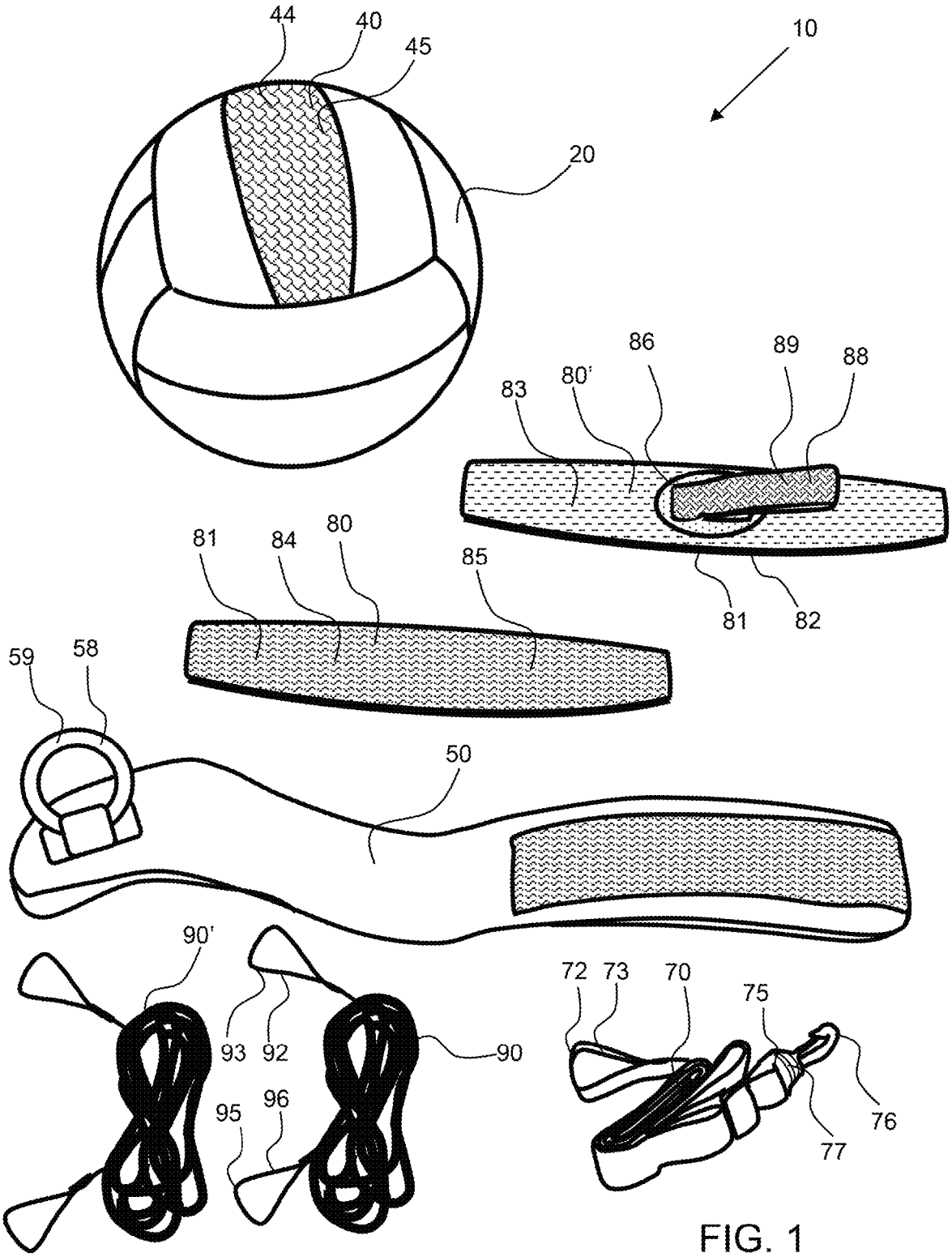
FIG. 1 shows a volleyball training system includes a training volleyball having ball attachment panels with hook-and-loop fastener exposed for detachable attachment of a tether panel that has a tether coupler configured to detachably attach with a tether, a belt tether or a suspension tether and a belt having a belt connector to connect with the belt tether.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, a volleyball training system 10 includes a training volleyball 20 having ball attachment panels 40 with ball hook-and-loop fastener 45 exposed for detachable attachment of a tether panel 80 by the panel hook-and-loop fastener 85. Tether panel 80 shows the attachment side 81 with the panel hook-and-loop fastener and tether panel 80' shows the exposed side 83 having a tether coupler 88, such as a tether coupler loop 89 configured to detachably attach with a tether, a belt tether 70 or a suspension tether 90, 90'. When practicing spiking the training volleyball 20, each of the suspension tethers 90, 90' may be detachably attached to the training volleyball by the tether couplers 88 of the left-side tether panel 84, attached to the ball left-side attachment panel and the right-side tether panel 86 attached to the right-side attachment panel (not shown). When practicing serving the training volleyball 20, the belt may be donned around a person's waist and the belt tether may be detachably attached between the belt, via the belt connector 58, such as a belt connector ring 59, on a belt tether belt-end and the training volleyball 20 by the tether coupler 88 of a tether panel detachably attached to the training volleyball.

As shown, each of the suspension tethers 90, 90' have a suspension tether ball-end connector 93 on the suspension tether ball-end 92, and a suspension tether retainer end connector 96 on the suspension tether retainer end 95, wherein the said connectors may be loops for retaining the suspension tether by extending the suspension tether around a ring or loop or around a retainer and passing the suspension tether through the loop in the end of the suspension tether.

As shown, the belt tether 70 has a belt tether ball-end 72 with a belt tether ball-end connector 73, such as a loop, and a belt tether belt-end 75 that has a belt tether belt connector 76, such as a clip or carabiner having a loop and clip. A belt tether belt swivel 77 may enable the belt tether belt-connector to swivel with respect to the belt tether extension to the training volleyball, to prevent the belt tether from twisting which may cause the connector to break or detach.

Referring now to FIGS. 2 to 7, an exemplary training volleyball 20 has six panel assemblies, each with three panels that are coupled together, such as by stitching to form the respective panel assembly. To form the training volleyball, each of the six panel assemblies are coupled to the adjacent or periphery panel assemblies, such as by stitching to form the volleyball. The front panel assembly 21 may include a valve 211 for filling a bladder 212 (indicated by the circle in dashed lines in FIG. 2) retained within the panel assemblies with air.

Each of the left-side panel assembly 24 and right-side panel assembly 26 include a ball attachment panel 40, having ball hook-and-loop fastener 45 thereon, such as the loop portion of the hook-and-loop fastener, as this is portion of the hook-and-loop fastener is softer than the hook portion that is more coarse. The training volleyball may be used for regular volleyball play or practice with the tether panels detached, as the hook-and-loop fastener is integral to a panel of the panel assembly and does not protrude out from the volleyball. Note that the left-side ball attachment panel 44 and right-side ball attachment panel 46 are the center panel of the respective left-side panel assembly 24 and right-side panel assembly 26. The center panel has a larger area than the two perimeter panels of the panel assembly and has convex extensions across the panel assembly that may more effectively secure a tether panel thereto. The left and right-side panels are used as an example and it is to be understood that a training volleyball may include a single ball attachment panel or two ball attachment panels that are preferably on opposing sides of the training ball, or three ball attachment panels, such as two on opposing sides and the third one extending orthogonally to the two on opposing sides, or four ball attachment panels, or even five or a ball attachment panel on each of the six panel assemblies.

Figure 16:
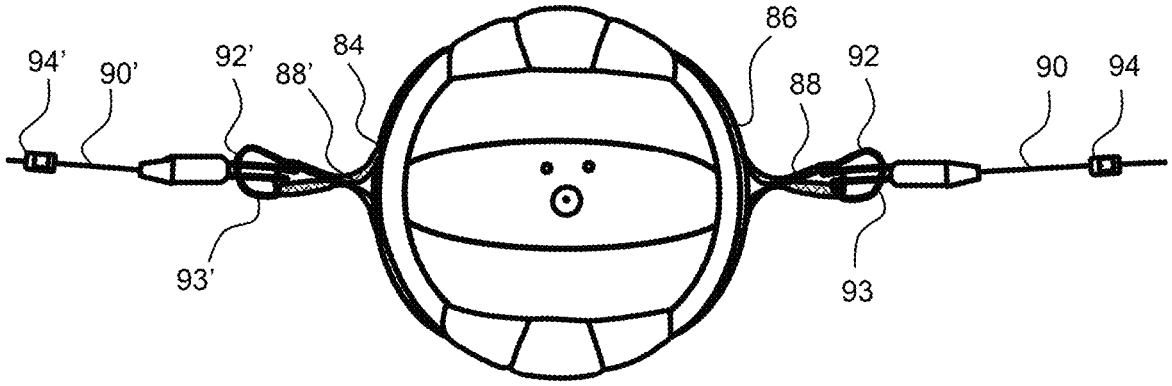
FIG. 16 shows the training volleyball having both the left-side tether panel and right-side tether panel attached and a suspension tether coupled to each for retaining the training volleyball between supports to practice spiking the volleyball.
Figure 17:
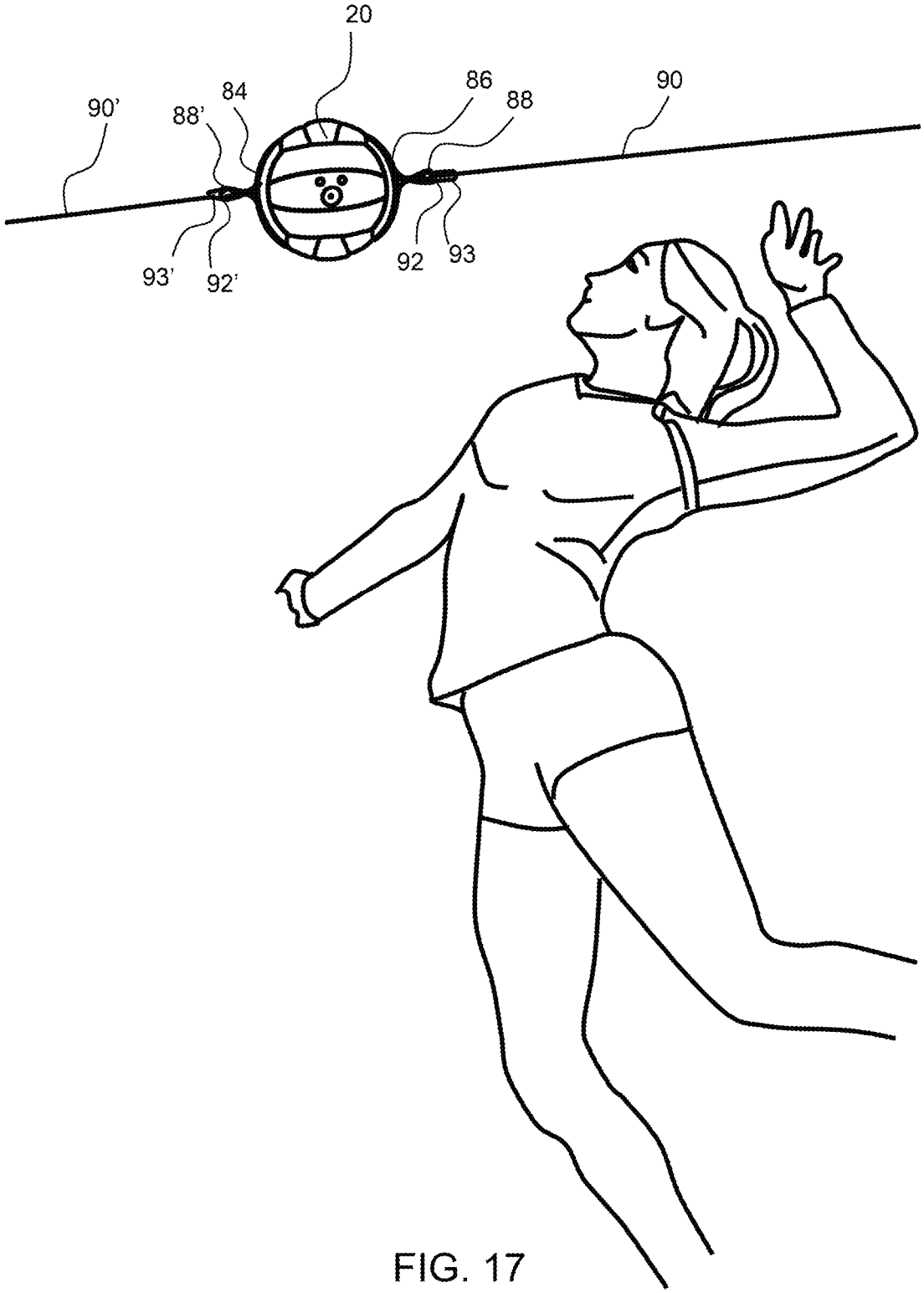
FIG. 17 shows the training volleyball as shown in FIG. 16, retained in an elevated position about the volleyball player, wherein the volleyball player is jumping up and spiking the volleyball.

The training volleyball 20 has a top panel assembly 22, a bottom panel assembly 28 and a back panel assembly 29, that contain may be conventional panel assemblies without attachments. The left-side ball attachment panel 44 and right-side ball attachment panel 46 are on opposing sides, diametrically opposite, or are on opposite panel assemblies to enable the spike training retaining configuration with a suspension tether extending from opposing sides of the training volleyball, as shown in FIGS. 16 and 17.

Figure 8:
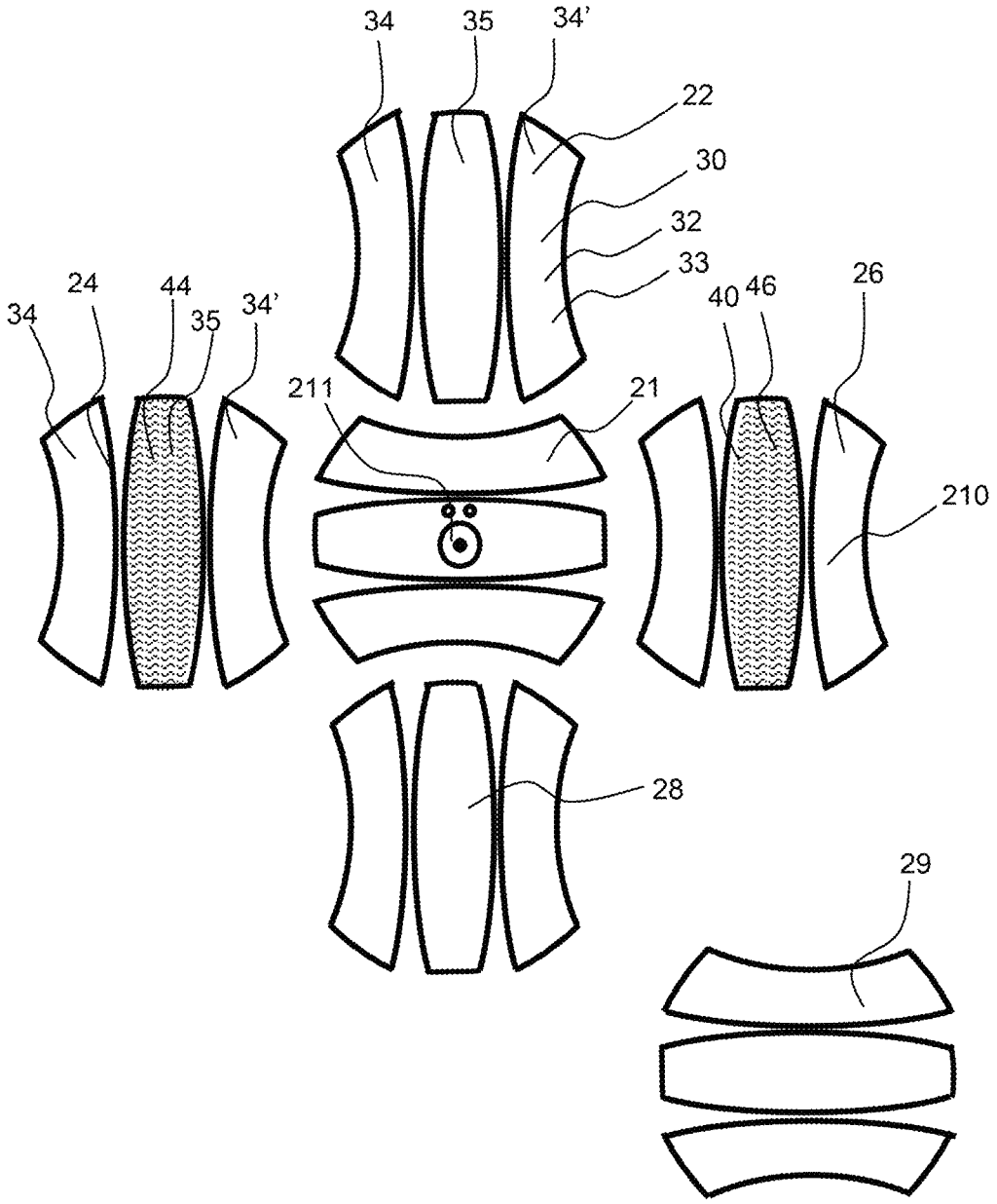
FIG. 8 shows an exploded view of the panel assemblies that form the outside of the training volleyball.

As shown in FIG. 8, the training volleyball 20 includes six panel assemblies including the top panel assembly 22, the front panel assembly 21, the bottom panel assembly 28, the back panel assembly 29, the left-side panel assembly 24 and right-side panel assembly 26. Each panel assembly includes a center panel 35 and two perimeter panels 34, 34' on opposing sides of the center panel. Also, the training volleyball 20 includes two ball attachment panels 40 on opposing sides of the volleyball, such as the left-side panel assembly 24 and right-side panel assembly 26. As shown, the left-side panel assembly has a ball left-side attachment panel configured as a center panel 35 of the panel assembly and the right-side panel assembly 26 has a right-side ball attachment panel 46 configured as the center panel of the panel assembly.

Figure 5:
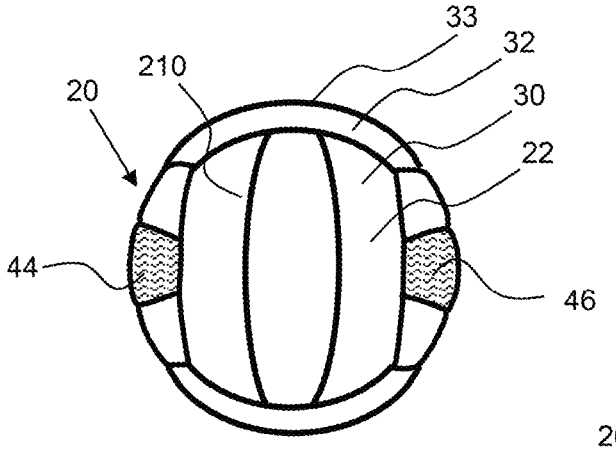
FIG. 5 shows a top view of a training volleyball and the top-side panel assembly having three panels.
Figure 3:
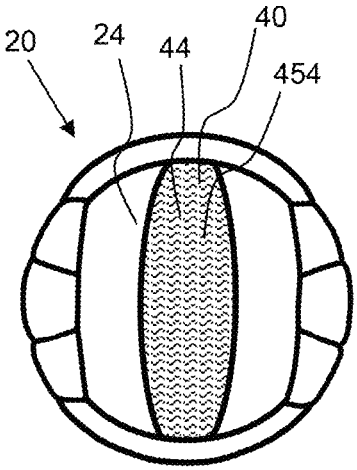
FIG. 3 shows a left view of a training volleyball and the left-side panel assembly having a ball left-side attachment panel.
Figure 2:
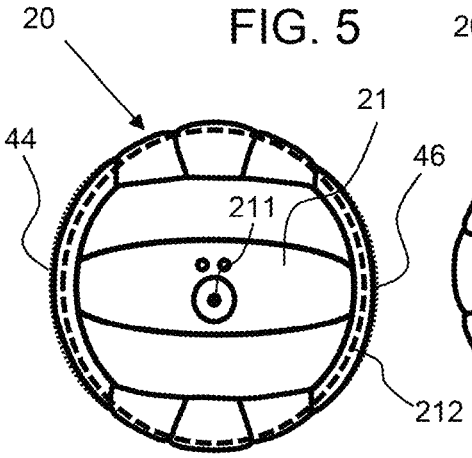
FIG. 2 shows a front view of a training volleyball and the front panel assembly having an inflation valve.
Figure 4:
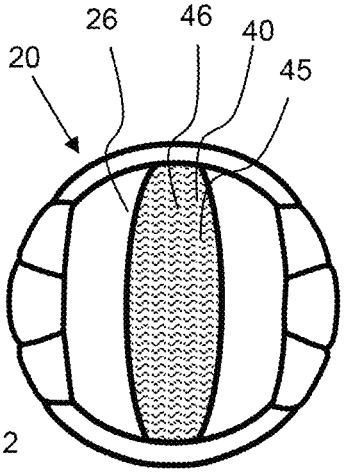
FIG. 4 shows a right view of a training volleyball and the right-side panel assembly having a ball right-side attachment panel.
Figure 6:
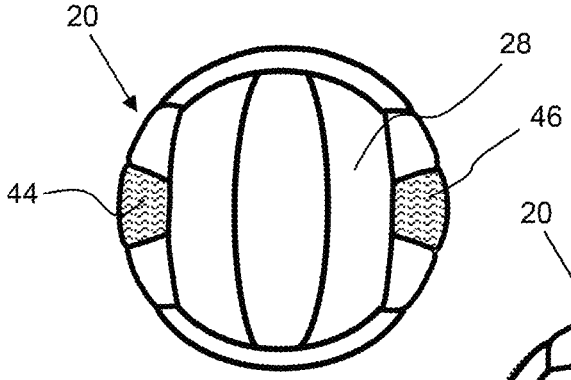
FIG. 6 shows a bottom view of a training volleyball and the bottom-side panel assembly having three panels.
Figure 7:
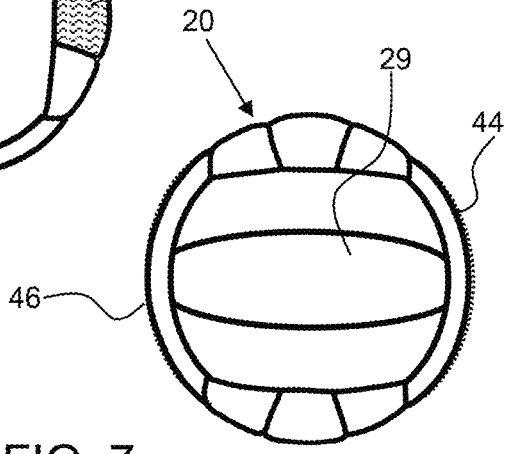
FIG. 7 shows a back view of a training volleyball and the back-side panel assembly having three panels.

Referring now to FIGS. 2 to 8, the ball attachment panels 40 are on two of the six panel assemblies 210 and may be on diametrically opposing sides of the training volleyball 20. In an exemplary embodiment, the training volleyball has only two ball attachment panels and they are configured on diametrically opposing sides of the training volleyball. Also, a training volleyball may have limited surface area occupied by the ball attachment panels to enable regular volleyball play with the tether panels detached. A training volleyball may consist of the two ball attachment panels on diametrically opposing sides of the training volleyball and the other panels may have a volleyball exterior layer 30, such as a panel layer 32 that may be a film layer 33 that is smooth such as a polymeric film layer, such as vinyl, or a leather layer that is smooth and free of hook-and-loop fastener material, to enable regular volleyball play without the tether couplers extending from the exterior surface of the training volleyball. Put another way, with the tether panels detached, the training volleyball may have a smooth exterior surface, as best shown in FIGS. 2, 5 and 6, having no protrusion more than 7 mm from the surface of the training volleyball, and preferably no more than 5 mm and even more preferably no more than 3 mm. The hook-and-loop fastener of the ball attachment enables regular volleyball play and may not extend over a very large portion of the exterior surface area of the training volleyball, such as no more than ⅔ of the surface area, or no more than ⅙ of the surface area. As shown in FIG. 8, the left-side ball attachment panel 44, is just one portion of the panel assembly, the center panel 35 and therefore is no more than 50% of the panel assembly area. Therefore, the exterior surface area occupied by the ball attachment panels is no more than ⅙ of the total exterior surface area with the remaining ⅚ of the exterior surface area having a volleyball exterior layer 30, such as a panel layer 32 that may be a film layer 33 of polymer or leather, for example.

Figure 9:
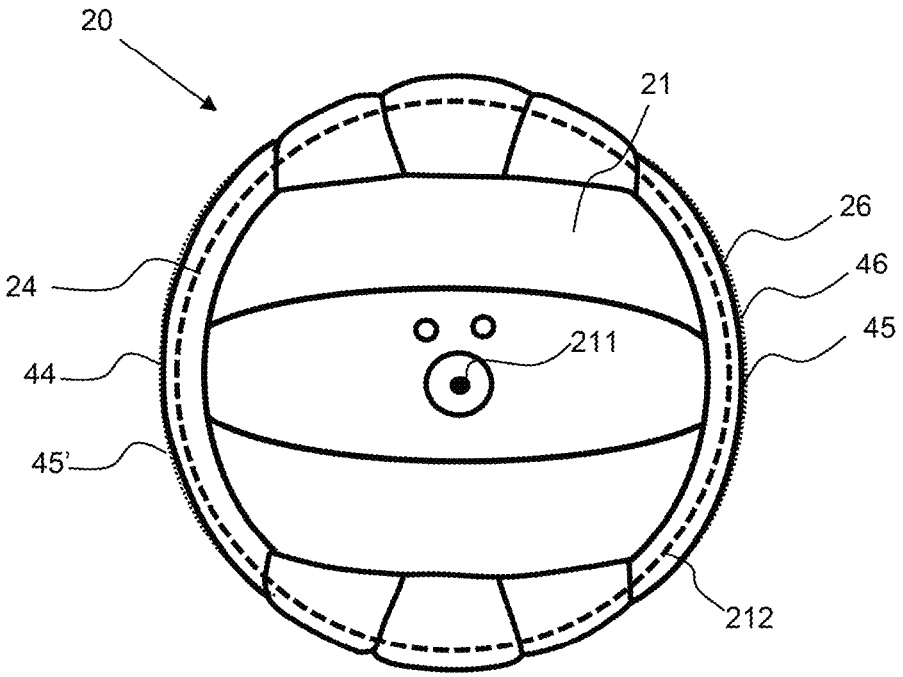
FIG. 9 shows a front view of the training volleyball having a ball left-side attachment panel on the left-side panel assembly and a ball right-side attachment panel on the right-side panel assembly.
Figure 10:
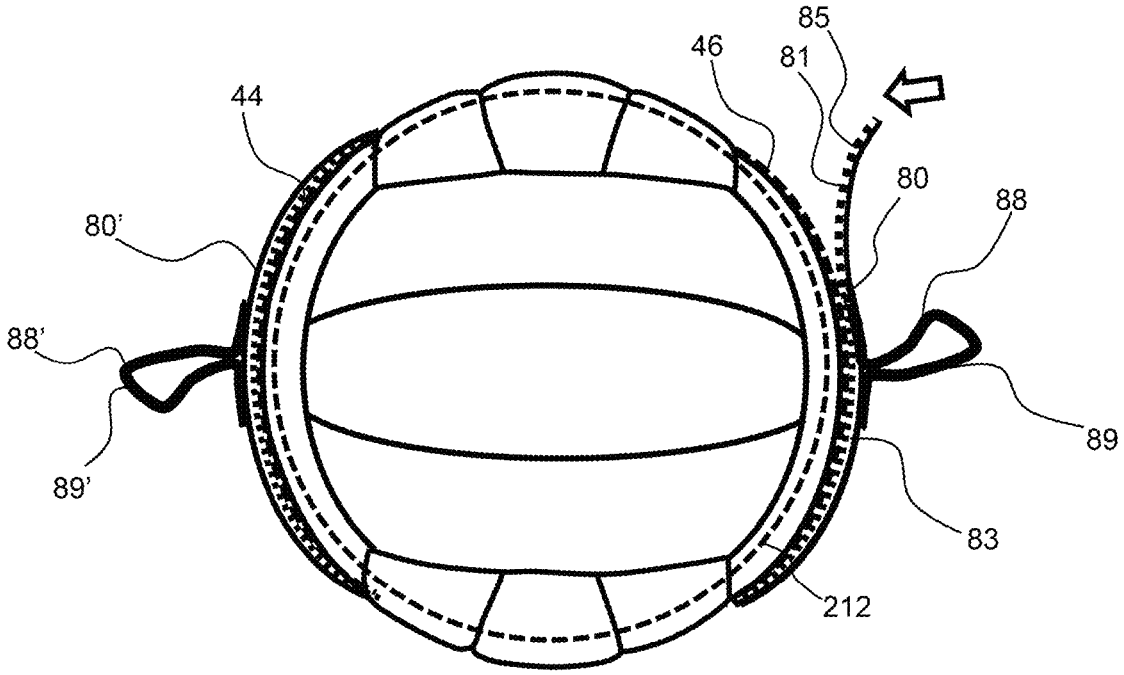
FIG. 10 shows a front view of the training volleyball shown in FIG. 9 with a left-side tether panel detachably attached to the ball left-side attachment panel on the left-side panel assembly and a right-side tether panel partially attached to the ball right-side attachment panel on the right-side panel assembly.

Referring now to FIGS. 9 and 10, the training volleyball 20 has a left-side ball attachment panel 44 on the left-side panel assembly 24 and a right-side ball attachment panel 46 on the right-side panel assembly 26, each having ball hook-and-loop fastener 45', 45 respectively. As shown in FIG. 10, a tether panel 80, a left-side tether panel 84 is detachably attached to the left-side ball attachment panel 44 and has a tether coupler 88' extending therefrom for attachment of a tether. Likewise, a right-side tether panel 86 is partially attached to the right-side ball attachment panel 46 and also has a tether coupler 88 extending therefrom.

Figure 11:
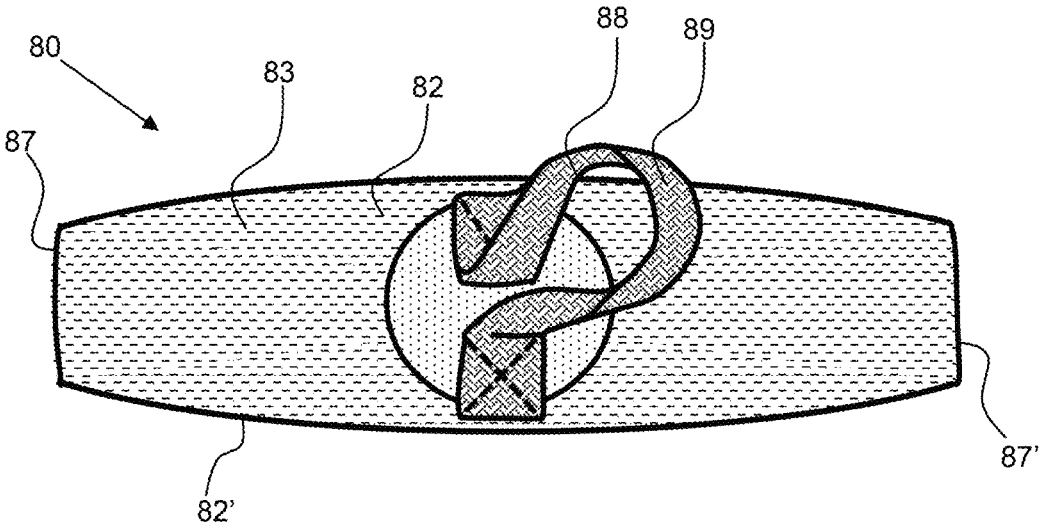
FIG. 11 shows an exposed side of a tether panel having a tether coupler, a tether coupler loop extending from the exposed side.
Figure 12:
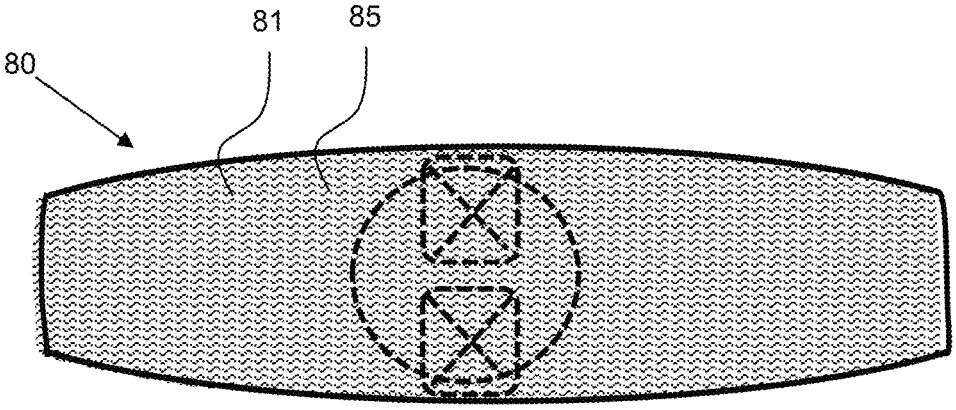
FIG. 12 shows an attachment side of the tether panel having a panel hook-and-loop fastener for detachable attachment to the ball hook-and-loop fastener of a ball attachment panel.

Referring now to FIGS. 11 and 12, an exemplary tether panel 80 has an exposed side 83 having a tether coupler 88, a tether coupler loop 89 extending from the exposed side and an attachment side 81 having a panel hook-and-loop fastener 85 for detachable attachment to the ball hook-and-loop fastener of a ball attachment panel. The tether panel has panel extensions 82, 82', the long sides of the tether panel extending between the panel ends 87, 87' that have a convex or convex curved shape.

Figure 13:
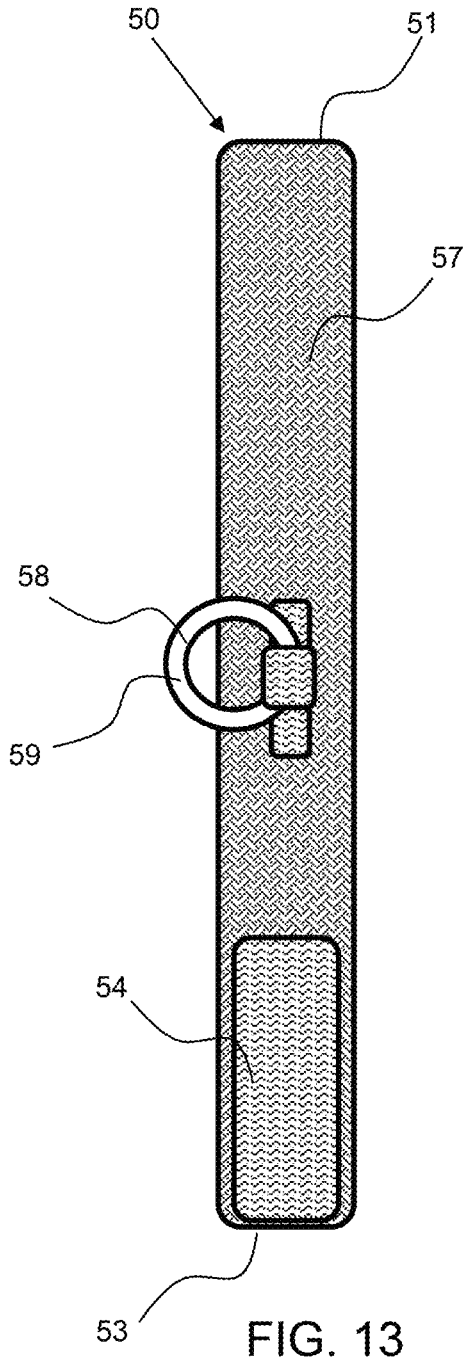
FIG. 13 shows an outside surface of a belt having a panel of belt-outside hook-and-loop fastener on a second end of the belt and a belt connector, a belt connector ring.
Figure 14:
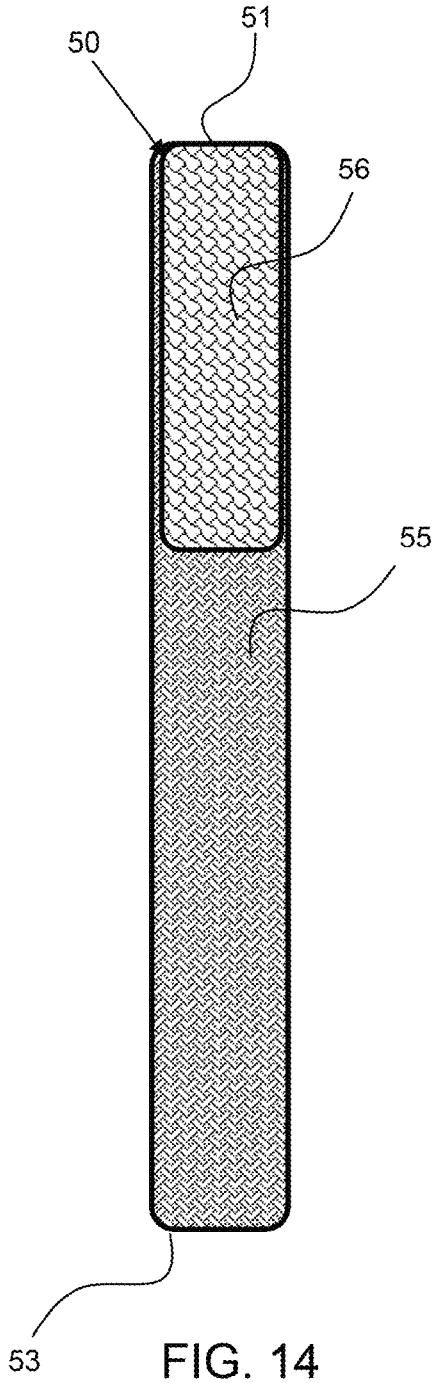
FIG. 14 shows an inside surface of a belt having a panel of belt-inside hook-and-loop fastener on first end of the belt.

Referring now to FIGS. 13 and 14, a belt 50 has an outside surface 57 with a panel of belt-outside hook-and-loop fastener 54 on a second end 53 of the belt and a belt connector 58, a belt connector ring 59, and an inside surface 55 with a belt-inside hook-and-loop fastener 56. The belt 50 extends a length from the first end 51 to the second end 53. The belt can be looped around a person's waist and the belt hook-and-loop fasteners can be detachably attached to secure the belt around a person to secure a belt tether to the person.

Figure 15:
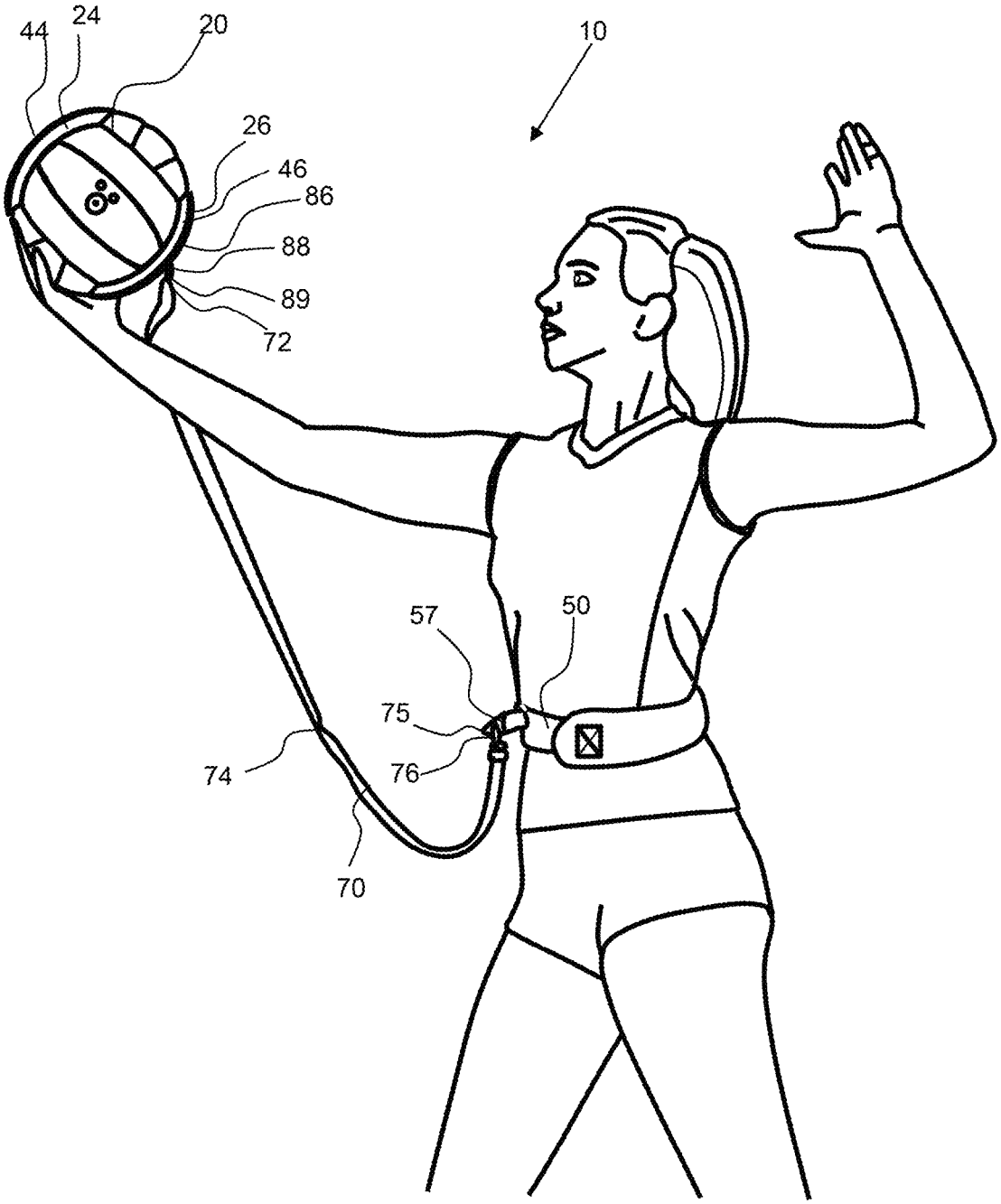
FIG. 15 shows a person practicing serves using the volleyball training system with the belt donned around her waist and the belt tether coupled to the belt connector on one end and coupled to the training volleyball on the opposing via the tether coupler of the right-side tether panel.

As shown in FIG. 15, a person is practicing serving the training volleyball 20 using the volleyball training system 10 with the belt 50 donned around her waist and the belt tether 70 coupled to the belt connector 58 on the belt tether belt-end 75 and coupled to the training volleyball 20 on the belt tether ball-end 72. A person may practice other volleyball hitting motions, such as spiking, setting and/or passing. The belt tether ball-end 72 is coupled to the tether coupler 88 and the tether panel 80, the right-side tether panel 86 is coupled to the right-side ball attachment panel 46. She can practice a serve and the belt tether will extend and then retract to bring the training volleyball back toward her to repeat the motion. The belt tether 70 has a length adjustment portion 74, such as a buckle, to enable the length of the belt tether to be adjusted. As mentioned herein, the belt tether may be coupled to the belt or to another support, such as an overhead support or a ground support to retain the training volleyball while practicing hitting the volleyball.

Referring now to FIGS. 16 and 17, the training volleyball 20 can be configured coupled to two suspension tethers to practice volleyball hitting techniques, such as serving, spiking, setting, digging, blocking or passing the volleyball. With the volleyball retained with both the left-side tether panel 84 and right-side tether panel 86 attached to the opposing ball attachment panel, and a suspension tether 90', 90 coupled respectively to each of the tether couplers 88', 88 for retaining the training volleyball between supports to practice hitting the volleyball. As shown in FIG. 17, the training volleyball 20 is retained in an elevated position above the volleyball player, wherein the volleyball player is jumping up and spiking the volleyball. With the volleyball retained in a lower position, setting and passing or even serving hitting practice may be conducted. As shown in FIG. 16, each of the suspension tether 90', 90 has a respective length adjustment portion 94, 94', such as a buckle to change the length of the suspension tethers.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention covers the modifications, combinations and variations of this invention provided they come within the scope of the appended claims and their equivalents.

What is claimed is:

1. A volleyball training system comprising:

a) a training volleyball comprising a plurality of panels comprising a plurality of ball attachment panels including:

i) a first ball attachment panel comprising ball hook-and-loop fastener on a first side of the training volleyball;

ii) a second ball attachment panel comprising ball hook-and-loop fastener on a second side, diametrically opposite said first side of the training volleyball;

iii) a bladder configured within the plurality of panels;

b) a first tether panel and a second tether panel, each comprising:

i) an exposed side comprising a tether coupler;

ii) an attachment side comprising hook-and-loop fastener configured to detachably attach respectively to the hook-and-loop fastener of the first and second ball attachment panels;

wherein the first tether panel and a second tether panel are detachably attachable to the training volleyball to enable the training volleyball to be used for volleyball play without the tether coupler extending out from the training volleyball.

2. The volleyball training system of claim 1, wherein the tether coupler is a tether coupler loop.

3. The volleyball training system of claim 1, further comprising:

a belt comprising a belt connector; and a belt tether extending from a belt end to a ball end and comprising a belt tether belt-connector configured on said belt end of the belt tether to detachably attach to said belt connector.

4. The volleyball training system of claim 3, wherein the belt tether is elastic.

5. The volleyball training system of claim 4, wherein the belt tether has a resting length of at 1 m.

6. The volleyball training system of claim 5, wherein belt tether has a force of elongation at 150% elongation at least 10 N.

7. The volleyball training system of claim 3, wherein the belt tether comprises a swivel between the belt tether belt-connector and the belt tether.

8. The volleyball training system of claim 1, further comprising:

a first suspension tether and a second suspension tether, each extending from a suspension tether ball end to a suspension tether retainer end and each comprising a suspension tether ball-end connector coupled to the suspension tether ball-end and configured to detachably attach with one of the tether couplers of the pair of tether panels; and wherein each of the pair of suspension tethers is elastic.

9. The volleyball training system of claim 8, wherein each of first and second suspension tethers has a resting length of at least 2 m.

10. The volleyball training system of claim 8, wherein each of the first and second suspension tethers have a force of elongation at 150% elongation at least 75 N.

11. The volleyball training system of claim 1, wherein the first ball attachment panel and second ball attachment panel are a center panel of a panel assembly comprising said center panel and two perimeter panels on opposing sides of the center panel.

12. The volleyball training system of claim 11, wherein the center panel has convex extensions along a length axis of the center panel.

13. The volleyball training system of claim 1, wherein the plurality of ball attachment panels consists of the first ball attachment panel and the second ball attachment panel.

14. The volleyball training system of claim 13, wherein the first ball attachment panel is configured on a diametrically opposite side of said training volleyball from the second ball attachment panel.

15. The volleyball training system of claim 14, wherein the plurality of ball attachment panels extend no more than ⅓ of the surface area of the training volleyball.

16. The volleyball training system of claim 15, wherein each of the plurality of panels excluding the plurality of ball attachment panels have a volleyball exterior layer.

17. The volleyball training system of claim 14, wherein the plurality of ball attachment panels extend no more than ⅙ of the surface area of the training volleyball.

18. The volleyball training system of claim 1, wherein the volleyball further comprises:

an inflation port extending through one of said plurality of panels for filing the bladder with air.

19. The volleyball training system of claim 1, wherein the training volleyball has a diameter between 20 cm to 22 cm and a weight between 260 g to 280 g.

20. A volleyball training system comprising:

a) a training volleyball comprising a plurality of panels including a plurality of ball attachment panels comprising:

i) a first ball attachment panel comprising ball hook-and-loop fastener on a first side of the training volleyball;

ii) a second ball attachment panel comprising hook-and-loop fastener on a second side, diametrically opposite said first side of the training volleyball;

iii) bladder configured within the plurality of panels, and iv) an inflation port extending through one of said plurality of panels for filing the bladder with air;

b) a first tether panel and a second tether panel, each comprising:

i) an exposed side comprising a tether coupler;

ii) an attachment side comprising hook-and-loop fastener configured to detachably attach respectively to the hook-and-loop fastener of the first and second ball attachment panels;

c) a belt comprising a belt connector;

d) a belt tether extending from a belt end to a ball end and comprising a belt tether belt-connector configured on said belt end of the belt tether to detachably attach to said belt connector; and e) a first suspension tether and a second suspension tether, each extending from a suspension tether ball end to a suspension tether retainer end and each comprising a suspension tether ball-end connectors coupled to the suspension tether ball-end and configured to detachably attach with the tether couplers of the respective first and second tether panels; and wherein the first tether panel and a second tether panel are detachably attachable to the training volleyball to enable the training volleyball to be used for volleyball play without the tether coupler extending out from the training volleyball.

* * * * *